US005197151A

United States Patent [19]

Jasper, Jr.

[11] Patent Number: 5,197,151

[45] Date of Patent: Mar. 30, 1993

[54] VARIABLE VOLUME FLUSHING DEVICE FOR WATER CONSERVATION

[76] Inventor: Louis J. Jasper, Jr., 12389 Kondrup Dr., Fulton, Md. 20759

[21] Appl. No.: 724,251

[22] Filed: Jul. 1, 1991

[51] Int. Cl.[5] ..... E03D 5/09

[52] U.S. Cl. ..... 4/378; 4/411; 4/415

[58] Field of Search ..... 4/324, 325, 378, 405, 4/411, 412, 415, 390, 398, 413, 414; 116/307, 309, 313, 321

[56] References Cited

U.S. PATENT DOCUMENTS

| | | | |
|---|---|---|---|
| 3,939,501 | 2/1976 | Sargent | 4/78 |
| 4,152,793 | 5/1979 | Mills | 4/325 |
| 4,435,859 | 3/1984 | Barnowski | 4/324 |
| 4,901,377 | 2/1990 | Weir | 4/415 |

FOREIGN PATENT DOCUMENTS

| | | | |
|---|---|---|---|
| 0555590 | 3/1957 | Belgium | 4/405 |
| 0073604 | 12/1951 | Denmark | 4/411 |
| 3410140 | 4/1985 | Fed. Rep. of Germany | 4/415 |
| 0507366 | 12/1954 | Italy | 4/405 |
| 0593368 | 5/1959 | Italy | 4/398 |
| 1544900 | 2/1990 | U.S.S.R. | 4/415 |

*Primary Examiner*—William A. Cuchlinski, Jr.
*Assistant Examiner*—W. Morris Worth
*Attorney, Agent, or Firm*—Saul Elbaum; Jason M. Shapiro

[57] ABSTRACT

The overflow tube and ball valve of a conventional water tank are replaced with a collapsible tube, one end of which is located above the water outlet of the tank, and the other end of which is located above the water line in the tank and able to be compressed to allow water to flow through the tube thereby flushing the tank. The volume of water expelled from the tank is controlled by choosing an appropriate amount of compression. The compressed tube returns to its original height after flushing. In one embodiment of the invention, a handle on the exterior of the tank cover is used to compress the tube in a plunger-like motion. The handle is provided with markings corresponding to the amount of water flushed for a given vertical displacement of the handle. In another embodiment of the invention, a lever is positioned on the front wall of the tank and is able to cause rotation of a cantilever beam. At the free end of the beam is a connection to a vertical rod which is depressed by rotation of the lever. The vertical rod is attached to the upper end of the collapsible tube, and thus compresses same and causes the tank to flush. In this embodiment of the invention, the front wall of the tank is marked in such a manner as to enable a user to choose a suitable volume of water for flushing.

15 Claims, 2 Drawing Sheets

VARIABLE VOLUME FLUSHING DEVICE FOR WATER CONSERVATION

GOVERNMENTAL INTEREST

The invention described herein may be manufactured, used and licensed by or for the U.S. Government for governmental purposes without the payment to us of any royalties thereon.

BACKGROUND OF THE INVENTION

The present invention relates to the field of water conserving devices for use with a toilet flush tank. More particularly, the present invention relates to the field of devices allowing the user of a conventional toilet to manually select the amount of water to be used when flushing the toilet.

On the average, 40% of the water used in homes is flushed down the toilet. Conventional toilet flush tanks discharge the total volume of water contained within the tank each time they are flushed, regardless of whether solid or liquid waste is to be expelled from the toilet. Liquid waste, however, requires only a fraction of the water necessary to flush solid waste. Thus, a considerable amount of water is wasted each time liquid waste is flushed.

Of the water saving devices currently available, most are not installable by the average homeowner and involve considerable expense, making them unattractive. On the other hand, less expensive solutions typically do not allow the user to choose alternate volumes of water with which to flush the toilet.

SUMMARY OF THE INVENTION

Accordingly, it is an object of the present invention to conserve water by allowing the user of a toilet to control the amount of water expelled from the toilet flush tank in accordance with the type of waste to be flushed.

It is another object of the present invention to achieve water conservation with a mechanism that is simpler than that used in conventional toilets, or in other water conservation devices intended for use in conventional toilets.

It is still another object of the present invention to provide a flushing mechanism which is more reliable and less expensive to manufacture than conventional flushing mechanisms.

These objects and others not specifically enumerated are accomplished by replacing the overflow tube and ball valve of a conventional toilet with a collapsible tube, one end of which is located above the water outlet of the tank, and the other end of which may be compressed to allow water to flow through the tube thereby flushing the toilet. The volume of water expelled from the tank is controlled by the user of the toilet by choosing an appropriate amount of compression. Means are provided to restore the compressed tube to its original height after flushing.

In one embodiment of the invention thereof, the compressible tube is a polyethylene bellows, which as a consequence of its own resilience will recover to its original undeformed height after flushing.

In another embodiment of the invention thereof, a handle on the exterior of the tank cover is used to compress the tube in a plunger-like motion. It is a further aspect of this embodiment for the handle to be provided with markings corresponding to the amount of water flushed for a given vertical displacement of the handle.

In yet another embodiment of the invention thereof, a lever is positioned on the front wall of the tank and is able to cause rotation of a shaft which extends into the tank. The shaft is in turn connected to one end of a cantilever beam. At the free end of the beam is a connection to a vertical rod which is depressed by rotation of the lever. The vertical rod is attached to the upper end of the tube, and thus compresses same and causes the toilet to flush. It is an aspect of this embodiment for the front wall of the tank upon which the lever is located to be marked in such a manner as to enable a user of the toilet to choose a suitable volume of water for flushing.

BRIEF DESCRIPTION OF THE DRAWINGS

The preferred embodiments of the present invention will be described with reference to the accompanying drawings.

DESCRIPTION OF THE PREFERRED EMBODIMENTS

Figure 1:
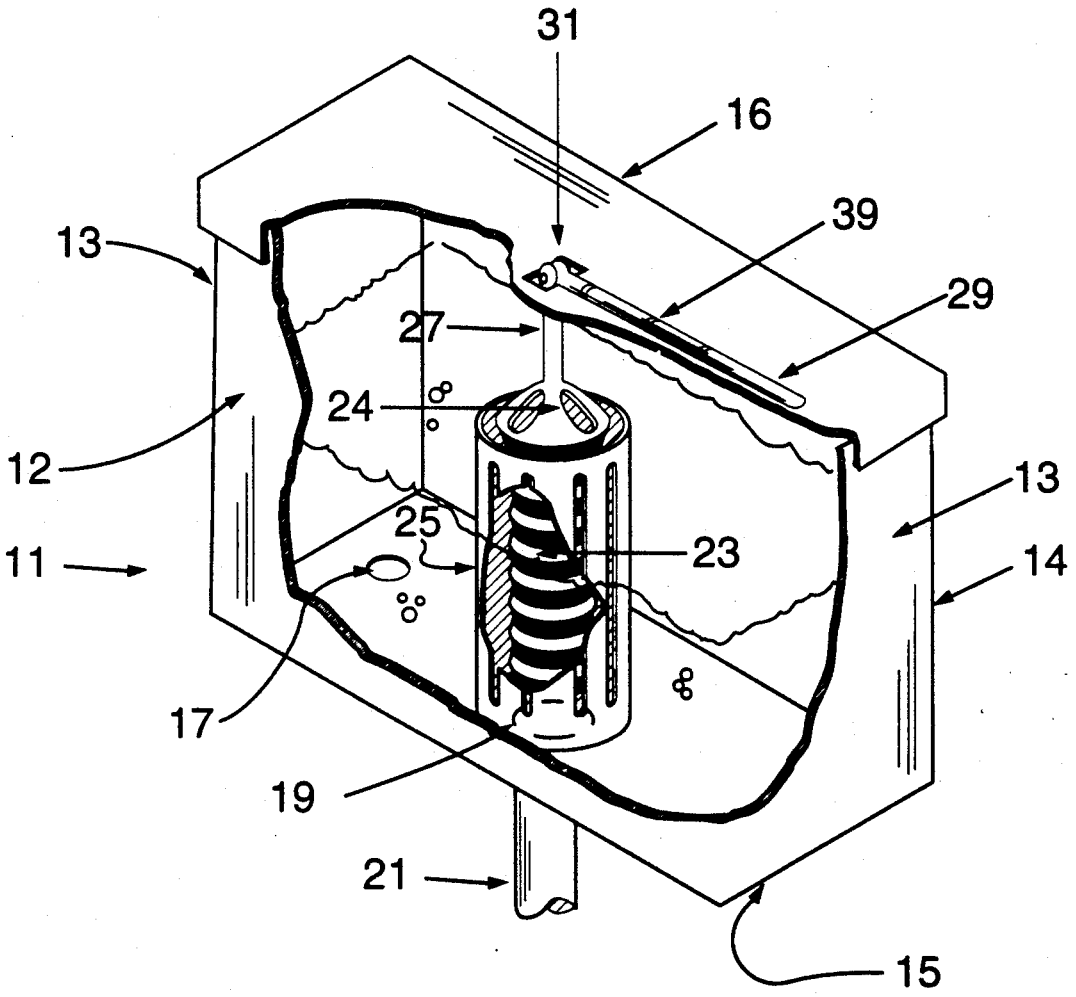
FIG. 1 is an isometric view, partly in section, of the variable volume flushing mechanism employing a flush handle which rests on top of the toilet tank cover.

Referring now to FIG. 1, the toilet flush tank 11 is of a conventional design having a front wall 12, two side walls 13, a back wall 14, and a bottom wall 15. The present invention, however, is not limited to use with this particular geometry of flush tank, and may be used, for example, with a cylindrical tank or tanks having any number of sides.

The tank 11 is provided with a cover 16, which may be removed in order to expose the interior parts. The water inlet mechanisms and water level control mechanisms are not shown in FIG. 1 for purposes of clarity.

The tank 11 is also provided with an inlet opening 17 and outlet opening 19 in its bottom wall 15. A discharge pipe 21 fits over the water outlet 19. A collapsible tube 23 having two open ends and a length less than the height of the tank 11 is made of a material such as low density polyethylene in the form of a bellows, which will provide complete elastic recovery when an applied stress is released. Other materials which are similarly flexible and strong can also be used, as well as spring-reinforced materials. One end of the tube 23 opens into the water outlet 19 and is affixed to the bottom of the tank 11 in such a manner as to form a water-tight seal. When the tube 23 is displaced vertically (i.e. compressed) to a point below the water level in the tank 11, a volume of water approximately equal to the cross-sectional area of the tank multiplied by the tube's linear displacement is made to flow down the tube 23, through the water outlet 19, and into the water discharge pipe 21, thereby flushing the toilet.

A rigid metal or plastic sleeve 25 surrounds the collapsible tube 23 and is attached to the bottom of the tank 11 with bolts and washers or an appropriate adhesive. The sleeve 25 is provided with a plurality of openings to allow water to flow into the region bounded by its walls, thereby surrounding the collapsible tube 23 as well. The sleeve 25 should have the same cross-sectional geometry as the collapsible tube 23, but should be slightly larger to allow vertical compression of the tube while limiting its transverse motion.

A handle 29 is made to lie flat on the tank cover 16 when not in use. A pivot joint 31 allows the handle 29 to be rotated from a horizontal position (as shown in FIG. 1) into a vertical position for flushing. The pivot joint 31 also serves to connect the handle 29 to a rod 27, which is in turn connected to a cap 24 on the top end of the tube 23. The cap 24 is provided with openings to allow water flow into the tube 23 when it is compressed below the water level in the tank 11. The length of the handle 29 should be no more than the height of tank 11 which would allow the entire contents of the tank 11 to be expelled if one so desired. The rod 27 should be adjustable to allow the handle 29 to lie flat on the tank cover 16. In addition, the handle 29 should be removable from the rod 27 at the pivot joint 31, to allow the tank cover 16 to be easily removed.

To operate the flushing mechanism, one rotates the handle 29 until it is vertical, then presses downward to release water through the top of the collapsible tube 23, the water outlet 19, and discharge pipe 21. The handle 29 is provided with markings 39 which when aligned with the top of the tank cover 16 indicate the volume of water flushed.

When the handle 29 is released, the collapsible tube 23 returns to its original uncompressed state as shown in FIG. 1. Water then enters the tank 11 up to the level controlled by the inlet mechanism but no higher than the top of the collapsible tube 23.

Figure 2:
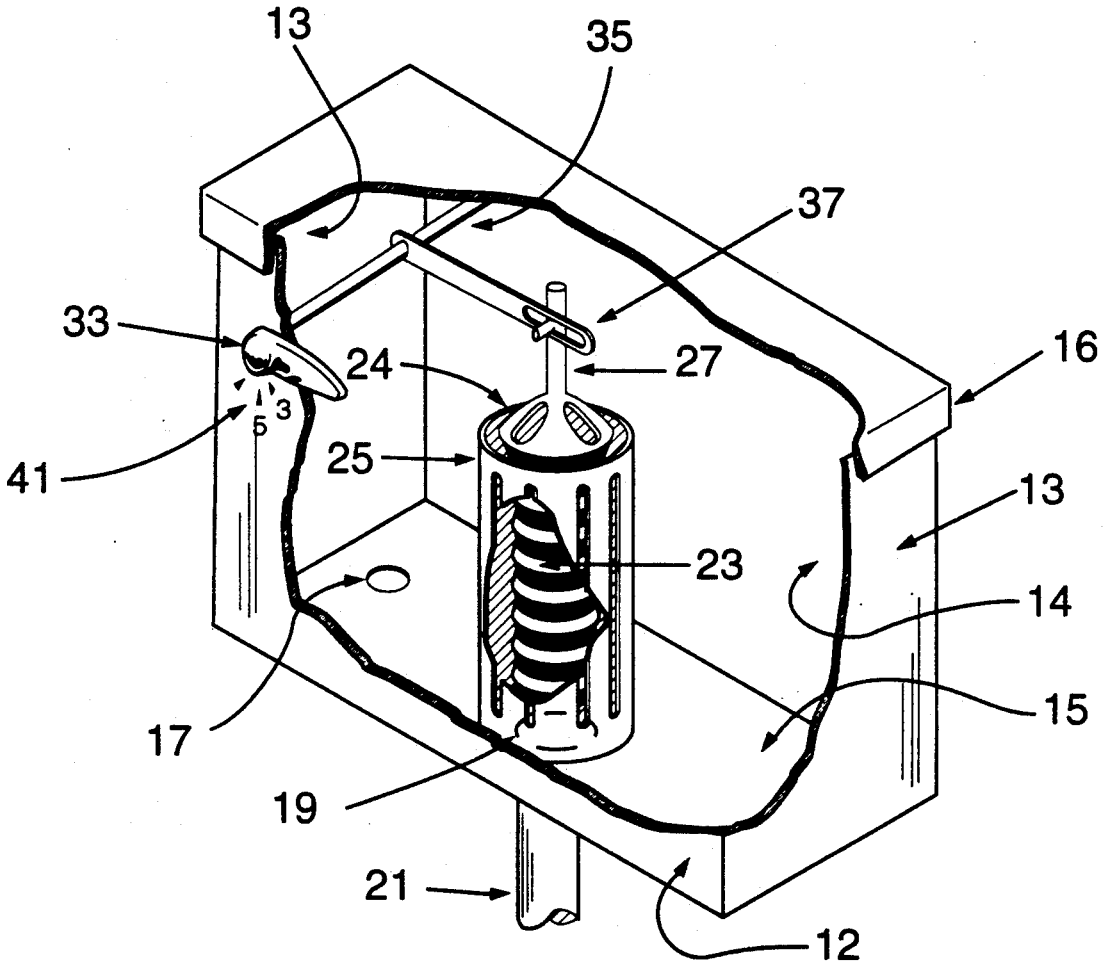
FIG. 2 is an isometric view, partly in section, of the variable volume flushing mechanism employing a flush lever on the front wall of the toilet tank.

In another embodiment, illustrated in FIG. 2, the flushing mechanism is actuated by means of a lever 33 which is located on the front wall 12 of the tank 11. The lever 33 extends perpendicularly from a shaft 35, which is made to turn when the lever 33 is rotated. One end of a cantilever beam 37 is fixedly attached to the shaft 35 (or, alternatively, directly to the lever 33), so that rotation of the lever 33 causes the beam 37 to move in an arc above the collapsible tube 23, cap 24, and rod 27 assembly. The free end of the beam 37 is connected to the rod 27 in such a way that the arc-like motion created by rotation of the lever 33 is converted into a vertical displacement of the tube 23. This can be accomplished by providing the beam 37 with a slot in its free end, and allowing a protrusion from the rod 27 (such as a knob or screw) to translate within the slot. Either the protrusion or the beam 37 will be able to move through the sleeve 25 through a slot located therein.

The lever 33 will remain in a horizontal position while not in use. Rotation of the lever 33 in a clockwise motion causes the beam 37 to rotate in a similar fashion, and the rod 27 to move downward. This, in turn, forces the collapsible tube 23 to compress, allowing water through its top, and causes the toilet to flush. Markings on the front wall 12 of the tank 11 are arranged in a circular pattern at points around the sweep of the lever 33 to indicate what volume of water has been flushed for a given rotation of the lever 33.

While there has been described and illustrated specific embodiments of the invention, it will be obvious that various changes, modifications and additions can be made herein without departing from the field of the invention which should be limited only by the scope of the appended claims.

We claim:

1. A toilet flushing apparatus, said apparatus comprising:

a tank having two side walls, a front wall, a back wall, and a bottom wall, said bottom wall provided with separate water supply and water outlet openings for the introduction and expulsion of water into and from said tank;

means for filling said tank with a predetermined volume of water;

a collapsible tube having two open ends and a length no greater than the height of said tank, one end of said tube being disposed over said water outlet opening and sealed in a water-tight manner to the bottom of said tank, said tube further provided with means to effect complete recovery of its length after said tube has been compressed lengthwise and released;

means to limit lateral motion of said tube during compression, said motion limiting means defining a vertical cavity in which said tube is located, and further allowing the flow of water into said cavity;

means to compress said tube lengthwise, whereby a volume of water approximately equal to the cross sectional area of said tank multiplied by the vertical distance said tube has been compressed, will enter the free end of said tube and be expelled from said tank causing the toilet to flush.

2. A toilet flushing apparatus, said apparatus comprising:

a tank having two side walls, a front wall, a back wall, and a bottom wall, said bottom wall provided with separate water supply and water outlet openings for the introduction and expulsion of water into and from said tank;

means for filling said tank with a predetermined volume of water;

a collapsible tube having two open ends and a length no greater than the height of said tank, one end of said tube being disposed over said water outlet opening and sealed in a water-tight manner to the bottom of said tank, said tube being a polyethylene bellows, which upon compression and subsequent release will return to its uncompressed height;

means to limit lateral motion of said tube during compression, said motion limiting means defining a vertical cavity in which said tube is located, and further allowing the flow of water into said cavity;

means to compress said tube lengthwise, whereby a volume of water approximately equal to the cross sectional area of said tank multiplied by the vertical distance said tube has been compressed, will enter the free end of said tube and be expelled from said tank causing the toilet to flush.

3. A toilet flushing apparatus, said apparatus comprising:

a tank having two side walls, a front wall, a back wall, and a bottom wall, said bottom wall provided with separate water supply and water outlet openings for the introduction and expulsion of water into and from said tank;

means for filling said tank with a predetermined volume of water;

a collapsible tube having two open ends and a length no greater than the height of said tank, one end of said tube being disposed over said water outlet opening and sealed in a water-tight manner to the bottom of said tank, said tube further provided with means to effect complete recovery of its length after said tube has been compressed lengthwise and released;

means to limit lateral motion of said tube during compression, said motion limiting means defining a vertical cavity in which said tube is located, and further allowing the flow of water into said cavity;

means to compress said tube lengthwise, whereby a volume of water approximately equal to the cross sectional area of said tank multiplied by the vertical distance said tube has been compressed, will enter the free end of said tube and be expelled from said tank causing the toilet to flush;

wherein said tank is provided with a cover, and said compression means comprises a rigid cap which is fixedly attached to the free end of said tube, said cap being provided with openings to allow the flow of water into said tube; a rigid rod which is fixedly attached to said cap, and which extends vertically through an opening in said cover; and a handle which is pivotally ad removably attached to said rod at a location outside of said tank and said tank cover, whereby said handle may be rotated into a vertical position and depressed to effect compression of said tube, thereby flushing said toilet.

4. The invention of claim 3 wherein said handle is provided with one or more markings along its length corresponding to particular volumes of water which, upon depression of said handle to a point where one of said markings aligns with said cover, allows the user to said toilet to determine the volume of water expelled when the toilet is flushed.

5. A toilet flushing apparatus, said apparatus comprising:

a tank having two side walls, a front wall, a back wall, and a bottom wall, said bottom wall provided with separate water supply and water outlet openings the introduction and expulsion of water into and from said tank;

means for filling said tank with a predetermined volume of a collapsible tube having two open ends and a length no greater than the height of said tank, one end of said tube being disposed over said water outlet opening and sealed in a water-tight manner to the bottom of said tank, said tube further provided with means to effect complete recovery of its length after said tube has been compressed lengthwise and released;

means to limit lateral motion of said tube during compression, said motion limiting means defining a vertical cavity in which said tube is located, and further allowing the flow of water into said cavity;

means to compress said tube lengthwise, whereby a volume of water approximately equal to the cross sectional area of said tank multiplied by the vertical distance said tube has been compressed, will enter the free end of said tube and be expelled from said tank causing the toilet to flush;

wherein said compression means comprises a rigid cap which is fixedly attached to the free end of said tube, said cap being provided with openings to allow the flow of water into said tube; a rigid rod which is fixedly attached to said cap, and which extends vertically toward the top of said tank; a lever located external to said tank and parallel to the front wall of said toilet, said level extending perpendicularly from a shaft which passes through said front wall into said tank; a cantilever beam which is fixedly attached at one end to said shaft, and attached at the other end to said vertical rod in such a manner as to cause vertical translation of said rod when said lever is rotated, thereby effecting compression of said tube and flushing of said toilet.

6. The invention of claim 5 wherein said front wall against which said lever is located is provided with one or more markings corresponding to particular volumes of water which, upon rotation of said lever to a point where one of said markings aligns with the free end of said lever, allows the user of said toilet to determine the volume of water expelled when the toilet is flushed.

7. The invention of claim 3, 4, 5, or 6 wherein said collapsible tube is a polyethylene bellows.

8. The invention of claim 1, 2, 3, 4, 5, or 6 wherein said means for limiting lateral translation of said tube is provided with means for allowing the flow of water into said cavity.

9. The invention of claim 7 wherein said means for limiting lateral translation of said tube is provided with means for allowing the flow of water into said cavity.

10. The invention of claim 8 wherein said means for allowing the flow of water into said cavity comprises a plurality of ports.

11. The invention of claim 9 wherein said means for allowing the flow of water into said cavity comprises a plurality of ports.

12. In a conventional toilet tank having separate water supply and water outlet openings, the improvement comprising a resilient overflow tube resembling a tubular bellows, one end of which is disposed over said water outlet opening, and the other end of which is open and connected to means for collapsing said tubular bellows, said tubular bellows being surrounded by a second tubular element which is substantially rigid and larger in diameter than said tubular bellows and which defines a vertical cavity in the region occupied by said bellows, said second tubular element being provided with means for promoting the flow of water into said cavity.

13. The invention of claim 12 wherein said means for promoting the flow of water into said cavity comprises a plurality of ports.

14. The invention of claim 12 or 13 wherein said resilient overflow tube is a polyethylene bellows.

15. The invention of claim 12 or 13 wherein said resilient overflow tube is a low-density polyethylene bellows.

* * * * *